US010135107B2

(12) United States Patent
Yoshino et al.

(10) Patent No.: US 10,135,107 B2
(45) Date of Patent: Nov. 20, 2018

(54) DIRECTIONAL COUPLER AND MICROWAVE HEATER PROVIDED WITH THE SAME

(71) Applicant: Panasonic Intellectual Property Management Co., Ltd., Osaka-shi, Osaka (JP)

(72) Inventors: Koji Yoshino, Shiga (JP); Tomotaka Nobue, Nara (JP); Kenji Yasui, Shiga (JP); Yoshiharu Omori, Shiaga (JP); Masafumi Sadahira, Shiga (JP); Masayuki Kubo, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 626 days.

(21) Appl. No.: 14/425,242

(22) PCT Filed: Jan. 31, 2014

(86) PCT No.: PCT/JP2014/000524
§ 371 (c)(1),
(2) Date: Mar. 2, 2015

(87) PCT Pub. No.: WO2014/119333
PCT Pub. Date: Aug. 7, 2014

(65) Prior Publication Data

US 2015/0244055 A1 Aug. 27, 2015

(30) Foreign Application Priority Data

Jan. 31, 2013 (JP) ..... 2013-016522
Aug. 6, 2013 (JP) ..... 2013-163009

(51) Int. Cl.
*H01P 5/18* (2006.01)
*H05B 6/70* (2006.01)
*H01P 5/107* (2006.01)

(52) U.S. Cl.
CPC ..... *H01P 5/181* (2013.01); *H01P 5/107* (2013.01); *H01P 5/184* (2013.01); *H05B 6/705* (2013.01); *H05B 6/707* (2013.01)

(58) Field of Classification Search
None
See application file for complete search history.

(56) References Cited

U.S. PATENT DOCUMENTS 3,377,571 A 4/1968 Kinsey
4,211,911 A 7/1980 Dehn
(Continued)

FOREIGN PATENT DOCUMENTS

JP 61-128805 U 8/1986
JP 3-297202 A 12/1991
(Continued)

OTHER PUBLICATIONS

International Preliminary Report on Patentability, and English language translation thereof, in corresponding International Application No. PCT/JP2014/000524, dated Aug. 13, 2015, 10 pages.
(Continued)

*Primary Examiner* — Ibrahime A Abraham
*Assistant Examiner* — John J Norton
(74) *Attorney, Agent, or Firm* — Brinks Gilson & Lione

(57) ABSTRACT

A directional coupler according to the invention includes an opening in a wall surface of a waveguide, and a coupling line on an outer side of the waveguide. The opening is configured to not cross a tube axis of the waveguide in plan view, and to emit a circularly polarized wave. The coupling line includes first and second transmission lines and output parts
(Continued)

disposed at both ends, the first and second transmission lines extending across the opening to cross the tube axis in plan view and being opposed to each other across the center of the opening. The first and second transmission lines are interconnected at a position displaced from an area vertically above the opening.

11 Claims, 10 Drawing Sheets

(56) References Cited

U.S. PATENT DOCUMENTS

| | | | | |
|---|---|---|---|---|
| 5,216,432 | A | 6/1993 | West | |
| 6,707,349 | B1 | 3/2004 | Huang et al. | |
| 2004/0130409 | A1* | 7/2004 | Lee | H01P 5/188 333/109 |

FOREIGN PATENT DOCUMENTS

| | | | |
|---|---|---|---|
| JP | 5-190271 | | 7/1993 |
| JP | 6-132710 | A | 5/1994 |
| JP | 8-171985 | A | 7/1996 |
| JP | 2004-235972 | A | 8/2004 |
| JP | 2009-171094 | A | 7/2009 |

OTHER PUBLICATIONS

Extended Search Report in corresponding European Application No. 14745823.6 dated Jan. 26, 2016, 7 pages.

Rao, J. S., et al., "Analysis of Small Aperture Coupling Between Rectangular Waveguide and Microstrip Line," *IEEE Trans. Microwave Theory and Techniques*, vol. 29, No. 2, Feb. 1981, 6 pages.

International Search Report, and English language translation thereof, in corresponding International Application No. PCT/JP2014/000524, dated Apr. 22, 2014, 5 pages.

* cited by examiner

DIRECTIONAL COUPLER AND MICROWAVE HEATER PROVIDED WITH THE SAME

This application is a 371 application of PCT/JP2014/000524 having an international filing date of Jan. 31, 2014, which claims priority to JP 2013-016522 filed Jan. 31, 2013 and JP 2013-163009 filed Aug. 6, 2013, the entire contents of which are incorporated herein by reference.

TECHNICAL FIELD

The invention relates to a directional coupler that detects the power level of a microwave transmitted in a waveguide and a microwave heater provided with the directional coupler.

BACKGROUND ART

One of known devices for detecting the power level of a microwave transmitted in the waveguide is a directional coupler. The directional coupler individually detects a travelling wave and a reflected wave, which are bidirectionally transmitted in a waveguide. Directional couplers of different detection methods have been proposed. For example, various detection methods that have been proposed and actually used are: a method of transmitting a detected signal to another waveguide, a method of transmitting a detected signal to a coaxial line, and a method of transmitting a detected signal to a microstrip line.

Examples of a directional coupler that transmits a detected signal to another waveguide include a cross-shaped directional coupler described in Non-patent Document 1. In the cross-shaped directional coupler, wide faces of two waveguides are stacked into a cross shape, and connection faces of the two waveguides have two X-shaped openings at a predetermined interval.

Examples of a directional coupler that transmits a detected signal to a coaxial line include a directional coupler described in Patent Document 1. The directional coupler has an opening provided at a position corresponding to a tube axis of a wide face of a waveguide, a capacitor plate that is a microwave detecting part provided as opposed to the opening, and a detecting seat, two central conductors, and two connectors around the capacitor board.

Examples of a directional coupler that transmits a detected signal to a microstrip line include a directional coupler described in Patent Document 2. The directional coupler has an opening provided at a position corresponding to a tube axis of a wide face of a waveguide, a printed circuit board opposed to the opening, and a microstrip line that is a microwave detecting part and a detection circuit on the printed circuit board.

Examples of the directional coupler that transmits a detected signal to the microstrip line also include a directional coupler described in Patent Document 3. The directional coupler has two openings provided at positions corresponding to a tube axis of a wide face of a waveguide at a predetermined interval, a printed circuit board opposed to the two opening, and a microstrip line that is a microwave detecting part and two probes on the printed circuit board.

Although the directional couplers to be attached to the waveguide have been described, a directional coupler to be attached to a microwave heater has also been proposed (for example, refer to Patent Document 4).

PATENT DOCUMENT

Patent Document 1: Japanese Unexamined Patent Publication No. 03-297202

Patent Document 2: Japanese Unexamined Patent Publication No. 2004-235972

Patent Document 3: Japanese Unexamined Patent Publication No. 06-132710

Patent Document 4: Japanese Unexamined Patent Publication No. 05-190271

NON-PATENT DOCUMENT

Non-patent Document 1: Hiroshi Hasunuma and Katsuyoshi Takagi, "THE DESIGN OF A MICROWAVE BASIC CIRCUIT", Ohmsha Ltd., Dec. 25, 1964, pp. 258-260

SUMMARY OF THE INVENTION

Problems to be Solved by the Invention

However, the directional coupler that transmits the detected signal to another waveguide requires two waveguides, disadvantageously increasing the thickness of the device. Similarly, the directional coupler that transmits the detected signal to the coaxial line includes the detecting seats, the two central conductors, and the two connectors around the capacitor board, disadvantageously increasing the thickness of the device.

In contrast, in the directional coupler that transmits the detected signal to the microstrip line, the thicknesses of the microstrip line and the detection circuit are extremely small, and the two probes are provided in a space between the opening and the printed circuit board, keeping the device thin.

However, since this directional coupler has the opening at the position corresponding to the tube axis of the waveguide (the opening and the tube axis of the waveguide overlap with each other in plan view), the length from the opening to the microstrip line and the length of the probes need to be controlled with high accuracy. That is, with the configuration of this directional coupler, even when an opening enough long to correspond to the wavelength of the microwave transmitted in the waveguide is formed along the tube axis of the waveguide, the microwave is not freely emitted from the opening to the outside of the waveguide. This requires a mechanism to couple the electromagnetic field around the opening to the microstrip line. The electromagnetic field can be coupled to the microstrip line by making the width of the opening larger than the width of the microstrip line in the direction perpendicular to the tube axis of the waveguide. However, in this case, the coupling level greatly depends on the length from the opening to the microstrip line and the length of the probes.

Therefore, an object of the invention is to solve the conventional problems, and to provide a new directional coupler capable of eliminating the necessity of highly accurate size management while preventing upsizing of the device, and a microwave heater equipped with the directional coupler.

Means for Solving the Problems

To solve the conventional problems, a directional coupler according to the invention includes: an opening in a wall surface of a waveguide; and a coupling line disposed on an outer side of the waveguide, wherein the opening is configured to not cross a tube axis of the waveguide in plan view, and to emit a circularly polarized wave, the coupling line includes a first transmission line, a second transmission line, and output parts disposed at both ends of the coupling line, the first transmission line and the second transmission line extending across the opening in plan view and being opposed to each other across a center of the opening, and the first transmission line and the second transmission line are interconnected at a position displaced from an area vertically above the opening.

Effects of the Invention

An directional coupler according to the invention can eliminate the necessity of highly accurate size management while preventing upsizing of the device.

BRIEF DESCRIPTION OF THE DRAWINGS

The above and other objects and features of the invention will be apparent from the following concerning a preferred embodiment with respect to the accompanying drawings, in which.

DETAILED DESCRIPTION OF THE PREFERRED EMBODIMENTS

Figure 1:
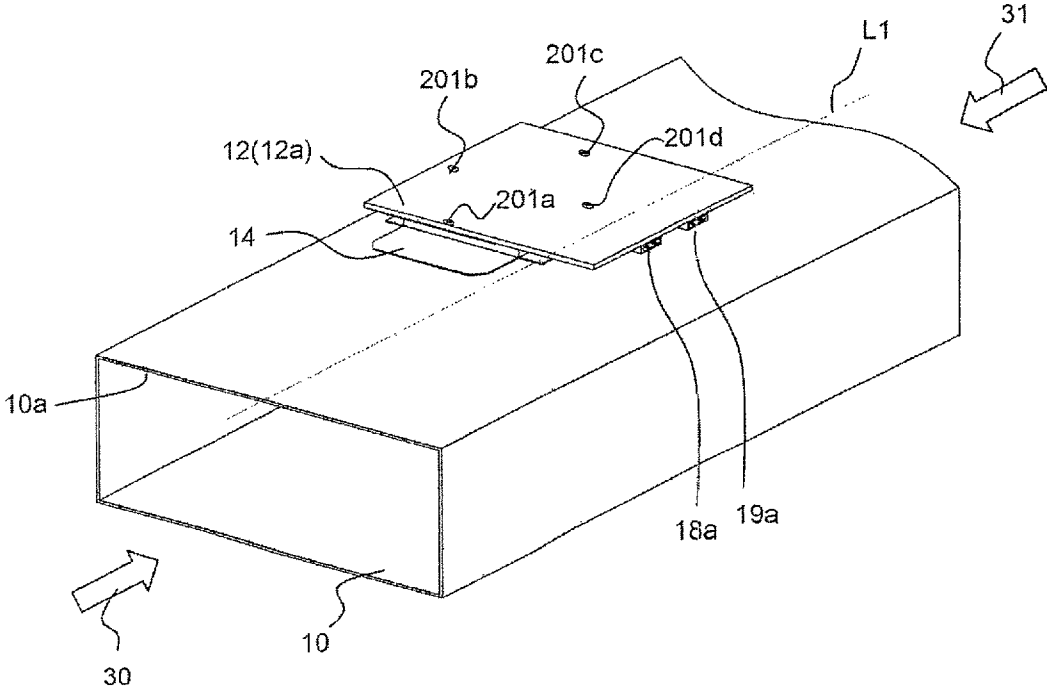
FIG. 1 is a perspective view illustrating a directional coupler in a first embodiment of the invention.

A directional coupler according to the invention includes: an opening in a wall surface of a waveguide; and a coupling line disposed on an outer side of the waveguide, wherein the opening is configured to not cross a tube axis of the waveguide in plan view, and to emit a circularly polarized wave, the coupling line includes a first transmission line, a second transmission line, and output parts disposed at both ends of the coupling line, the first transmission line and the second transmission line extending across the opening in plan view and being opposed to each other across a center of the opening, and the first transmission line and the second transmission line are interconnected at a position displaced from an area vertically above the opening.

With this configuration, since the opening is configured to not cross the tube axis of the waveguide in plan view, the microwave transmitted in the waveguide can be readily emitted to the outside of the waveguide. The microwave emitted to the outside of the waveguide is coupled on the coupling line.

With the above-mentioned configuration, the opening is configured to emit the circularly polarized wave. With this configuration, when the microwave transmitted in the waveguide is directed in opposite directions, the rotating directions of the circularly polarized wave emitted from the opening are also opposite to each other. With the configuration, the coupling line includes the first and second transmission lines that extend across the opening in plan view, and are opposed to each other across the center of the opening. With this configuration, the circularly polarized wave emitted from the opening (for example, anticlockwise) when the microwave is transmitted in the waveguide in one direction is mostly outputted to one output part through one of the first transmission line and the second transmission line. The circularly polarized wave emitted from the opening (for example, clockwise) when the microwave is transmitted in the waveguide in the opposite direction to the one direction is mostly outputted to the other output part through the other of the first transmission line and the second transmission line. Thereby, the microwave (travelling wave and the reflected wave) bidirectionally transmitted in the waveguide can be individually detected. That is, with such a configuration, the travelling wave and the reflected wave are individually detected by using the different rotating directions of the circularly polarized wave, providing a new directional coupler that can eliminate the necessity of highly accurate size management while preventing upsizing of the device.

The coupling line may be configured to a face of the printed circuit board, which is opposed to the opening. Since the thickness of the printed circuit board is extremely small, upsizing of the device can be prevented.

Preferably, the opening is configured of two long holes that cross each other into an X shape. As a result, the opening can emit a circularly polarized wave of a substantially complete round, and the rotating direction of the circularly polarized wave becomes more definite. This can individually detect the travelling wave and the reflected wave with high accuracy.

Preferably, the coupling line between a first coupling point located at the substantially center of a coupling area where the opening crosses the first transmission line, and a second coupling point located at the substantially center of a coupling area where the opening crosses the second transmission line, in plan view, is configured such that a microwave generated at the first coupling point and a microwave generated at the second coupling point correspond to a rotating direction of the circularly polarized wave, and have same phase at the first coupling point or the second coupling point. As a result, even in the state where the reflected wave is present (that is, the standing wave occurs in the waveguide), the directional coupler can be installed at any position, improving practical value.

Preferably, a conductive support part that is configured to support the printed circuit board on the outer face of the waveguide and to surround the opening in plan view is further provided, and a microwave reflective member is configured to the face of the printed circuit board which is not opposed to the opening. With this configuration, the microwave emitted from the opening can be prevented from leaking to the outside of the support part and the printed circuit board. This can also suppress unnecessary radiation of the microwave to electric parts and control signal lines near the support part and the printed circuit board, preventing malfunction.

Preferably, the support part has through holes through which both ends of the coupling line pass, and the output parts are disposed outside of the support part. With this configuration, the support part can prevent the microwave emitted from the opening from leaking to the outside of the support part and the printed circuit board, and only the signal detected by the coupling line can be taken out of the support part.

Preferably, the output parts are connected to respective detection circuits or terminal circuits outside of the support part. With this configuration, the detection circuits or the terminal circuits can be prevented from malfunctioning due to the radiation of the microwave emitted from the opening.

Preferably, the detection circuits or the terminal circuits are provided on the printed circuit board. With this configuration, the configuration of the printed circuit board provided with the coupling line and the detection circuits or the terminal circuits can be simplified, maintaining high reliability.

Preferably, the first transmission line and second transmission line extend substantially perpendicular to the tube axis in plan view. With this configuration, the effect of the impedance of the load connected to the waveguide can be reduced to maintain high accuracy of separation of the microwave bidirectionally transmitted in the waveguide.

Preferably, one end of the first transmission line and one end of the second transmission line are connected to a third transmission line substantially parallel to the tube axis in plan view. With this configuration, the separation of the microwave bidirectionally transmitted in the waveguide can be improved, and the configuration of the coupling line becomes qualitative, facilitating the design of a practical configuration.

A directional coupler and a microwave heater provided with the directional coupler in embodiments of the invention will be described below with reference to drawings. It should be noted that the invention is not limited to these embodiments.

First Embodiment

Figure 2:
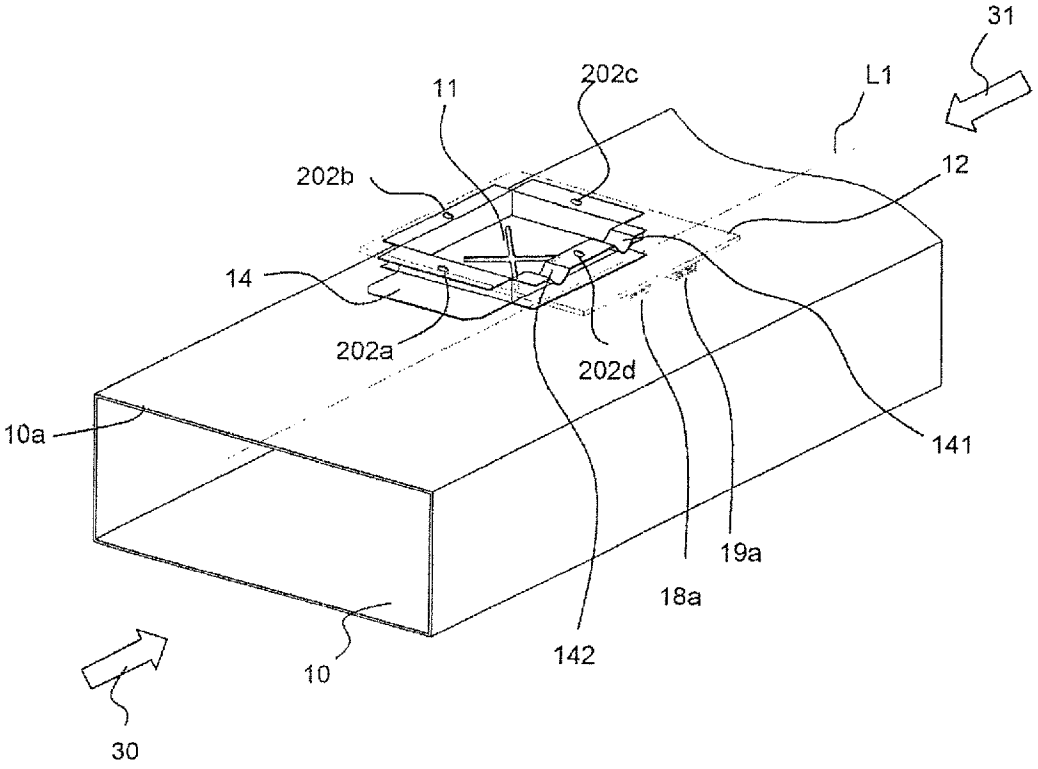
FIG. 2 is a perspective view illustrating the directional coupler in FIG. 1, with a printed circuit board removed.
Figure 3:
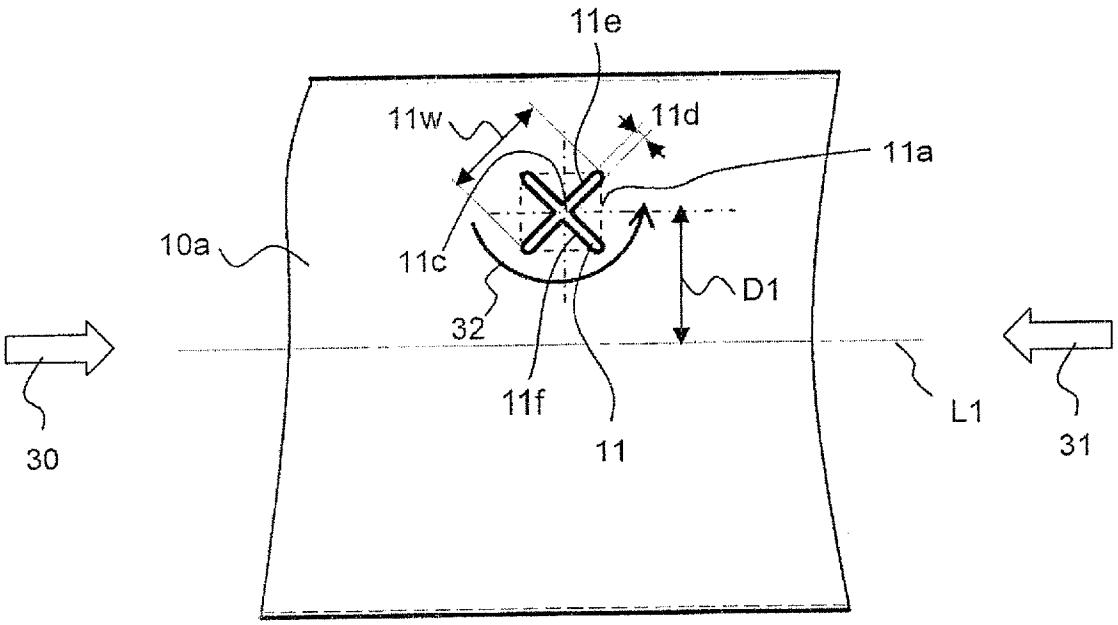
FIG. 3 is a plan view illustrating a waveguide of the directional coupler in FIG. 1.
Figure 4:
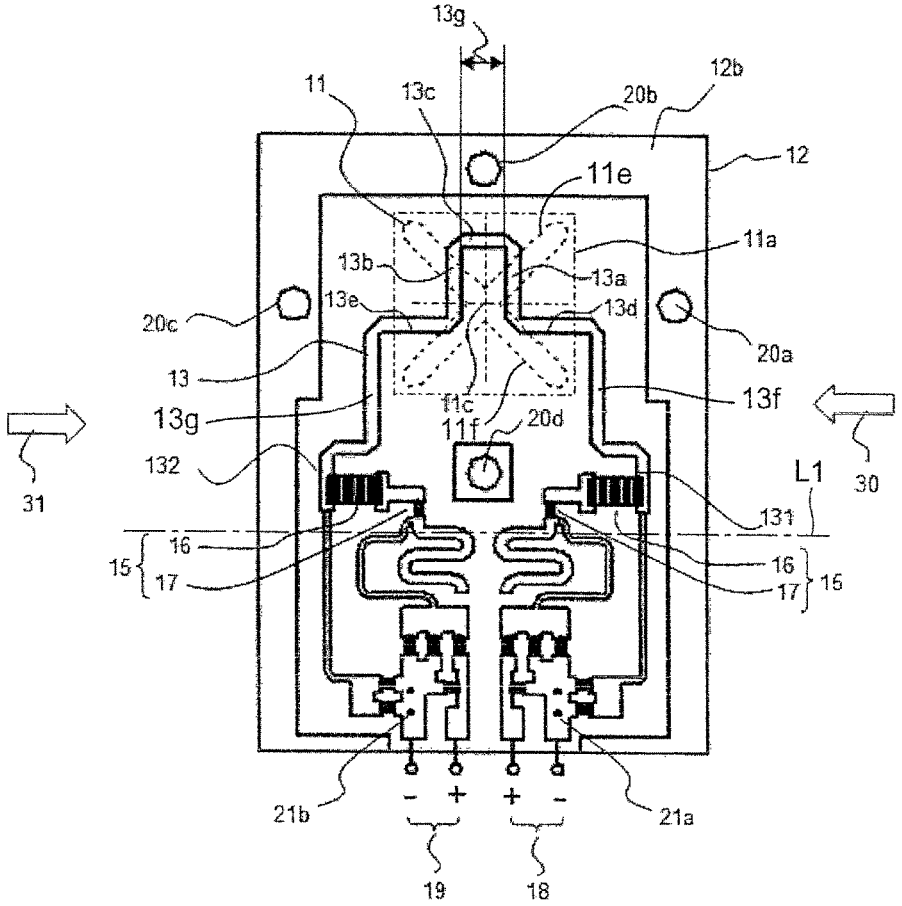
FIG. 4 is a circuit diagram of the printed circuit board of the directional coupler in FIG. 1.

FIG. 1 is a perspective view illustrating a directional coupler in a first embodiment of the invention. FIG. 2 is a perspective view illustrating the directional coupler in FIG. 1, with a printed circuit board removed. FIG. 3 is a plan view illustrating a waveguide of the directional coupler in FIG. 1. FIG. 4 is a circuit diagram of the printed circuit board of the directional coupler in FIG. 1.

As shown in FIG. 1 and FIG. 2, the directional coupler in the first embodiment is provided on a wall surface of a waveguide 10 that transmits a microwave. In the first embodiment, the waveguide 10 is a rectangular waveguide. A cross section of the waveguide 10, which is orthogonal to a tube axis L1 of the waveguide 10, is rectangular.

The directional coupler in the first embodiment includes an X-shaped opening (hereinafter referred to as cross opening) 11 configured to a wide face 10*a* of the waveguide 10, a printed circuit board 12 that is configured to the outer side of the waveguide 10 and opposed to the cross opening 11, and a support part 14 that is configured to an outer face of the waveguide 10 and supports the printed circuit board 12.

As shown in FIG. 3, the cross opening 11 is provided so as not to cross the tube axis L1 of the waveguide 10 in plan view (when looking down the cross opening 11 from the printed circuit board 12). An opening center 11*c* of the cross opening 11 is located away from the tube axis L1 of the waveguide 10 by a distance D1 in plan view. For example, the distance D1 is a quarter of a width of the waveguide 10. The cross opening 11 emits the microwave transmitted in the waveguide 10, as a circularly polarized wave, to the printed circuit board 12.

The shape of the cross opening 11 may be determined based on various conditions including the width and the height of the waveguide 10, the power level and the frequency band of the microwave transmitted in the waveguide 10, and the power level of the circularly polarized wave emitted from the cross opening 11. For example, given that the width of the waveguide 10 is 100 mm, the height of the waveguide 10 is 30 mm, the thickness of the wall surface of the waveguide 10 is 0.6 mm, and the maximum power level of the microwave transmitted in the waveguide 10 is 1000 W, the frequency band is 2450 MHz, and the maximum power level of the circularly polarized wave emitted from the cross opening 11 is about 10 mV, a length 11*w* and a width 11*d* of the cross opening 11 may be determined to about 20 mm and about 2 mm, respectively. In the first embodiment, the cross opening 11 is configured by crossing two long holes 11*e* and 11*f* into an X shape, and the crossing angle of the two long holes 11*e* and 11*f* is set to 90 degrees. However, the invention is not limited to this, and the crossing angle may be 60 or 120 degrees.

When the opening center 11*c* of the cross opening 11 corresponds to the tube axis L1 of the waveguide 10 (overlaps the tube axis L1 in plan view), the electric field does not rotate, but reciprocates in the transmitting direction. In this case, the cross opening 11 emits a linearly polarized wave. In contrast, when the opening center 11*c* displaces from the tube axis L1 even slightly, the electric field rotates. However, as the opening center 11*c* is closer to the tube axis L1 (the distance D1 is closer to 0 mm), the electric field rotates more distortedly. In this case, the cross opening 11 emits an elliptical circularly polarized wave (also referred to as elliptical polarized wave). When the distance D1 is set to about a quarter of the width of the waveguide 10 as in the first embodiment, the electric field rotates in a substantially complete round shape. In this case, since the cross opening 11 emits a circularly polarized wave of a substantially complete round, the rotating direction becomes more definite, enabling a travelling wave and a reflected wave to be individually detected with high accuracy.

A copper foil (not shown) as a microwave reflective member is applied to a face (hereinafter referred to as printed circuit board A face) 12*a* of the printed circuit board 12 which does not face the cross opening 11. For example, the copper foil covers the entire printed circuit board A face. This prevents the circularly polarized wave emitted from the cross opening 11 from penetrating the printed circuit board 12.

As shown in FIG. 4, a microstrip line 13 as a coupling line is configured to a face (hereinafter referred to as printed circuit board B face) 12*b* of the printed circuit board 12 which faces the cross opening 11. The microstrip line 13 is configured of, for example, a transmission line having a characteristic impedance of about 50 ohms. The microstrip line 13 surrounds the opening center 11*c* of the cross opening 11 in plan view.

More specifically, the microstrip line 13 includes a first transmission line 13*a* and a second transmission line 13*b*.

The first and second transmission lines 13*a*, 13*b* each cross the cross opening 11 in plan view, and are opposed to each other across the opening center 11*c* of the cross opening 11. In the first embodiment, the first and second transmission lines 13*a*, 13*b* are located vertically above a rectangular cross opening area 11*a* that encloses the cross opening 11, and is substantially perpendicular to the tube axis L1 of the waveguide 10.

One end of the first transmission line 13*a* and one end of the second transmission line 13*b* are connected to a third transmission line 13*c* substantially parallel to the tube axis L1 in plan view, at positions out of an area located vertically above the cross opening 11. The other end of the first transmission line 13*a* is connected to a transmission line 13*d* substantially parallel to the tube axis L1, and extends to the outside of the cross opening area 11*a* in plan view. The transmission line 13*d* is connected to an output part 131 via a transmission line 13*f*. The other end of the second transmission line 13*b* is connected to a transmission line 13*e* substantially parallel to the tube axis L1, and extends to the outside of the cross opening area 11*a* in plan view. The transmission line 13*e* is connected to an output part 132 via a transmission line 13*g*.

The output parts 131 and 132 are disposed outside of the support part 14 in plan view. The output parts 131 and 132 are connected to respective detection circuits 15 that are processing circuits which handle the level of a detected microwave signal as a control signal.

FIG. 4 shows an example of the detection circuits 15. In the first embodiment, each of the detection circuits 15 includes a chip resistor 16 and a schottky diode 17. The microwave signal outputted from the output part 131 is rectified through the chip resistor 16 and the schottky diode 17, and is converted into a DC voltage via a smoothing circuit configured of a chip resistor and a chip capacitor and then, is outputted to a detection output part 18. Similarly, the microwave signal outputted from the output part 132 is rectified through the chip resistor 16 and the schottky diode 17, and is converted into a DC voltage via a smoothing circuit configured of a chip resistor and a chip capacitor and then, is outputted to a detection output part 19.

For example, four printed circuit board-attachment holes 20*a*, 20*b*, 20*c*, and 20*d* and two pin holes 21*a* and 21*b* pass through the printed circuit board 12 in the thickness direction of the printed circuit board 12. On the printed circuit board B face 12*b* opposed to the cross opening 11, a copper foil as a ground face is formed around the printed circuit board-attachment holes 20*a*, 20*b*, 20*c*, and 20*d* and the pin holes 21*a* and 21*b*. The area where the copper foil is formed (hereinafter referred to as coppered part) has the same potential (ground potential) as the printed circuit board A face 12*a* that does not face the cross opening 11.

The printed circuit board 12 is assembled and fixed by screwing screws 201*a*, 201*b*, 201*c*, and 201*d* into the support part 14 through the printed circuit board-attachment holes 20*a*, 20*b*, 20*c*, and 20*d*, respectively. As shown in FIG. 2, the support part 14 is provided with threaded holes 202*a*, 202*b*, 202*c*, and 202*d* into which the screws 201*a*, 201*b*, 201*c*, and 201*d* are screwed, respectively. The threaded holes 202*a*, 202*b*, 202*c*, and 202*d* are formed in a flange of the support part 14.

The support part 14 is conductive, and surrounds the cross opening 11 in plan view. That is, the support part 14 functions as a shield for preventing the circularly polarized wave emitted from the cross opening 11 from leaking out of the support part 14.

As shown in FIG. 2, the support part 14 has through holes 141 and 142 through which both ends of the microstrip line 13 pass. Thereby, the output parts 131 and 132 at both ends of the microstrip line 13 can be located outside of the support part 14. That is, the through holes 141 and 142 each function as an extraction part that extracts the microwave signal transmitted through the microstrip line 13 to the outside of the support part 14. As shown in FIG. 2, the through holes 141 and 142 can be formed by denting the flange of the support part 14 away from the printed circuit board 12.

FIG. 1 and FIG. 2 show connectors 18*a* and 19*a* for coupling to the detection output parts 18 and 19 shown in FIG. 4.

Although the directional coupler that detects the microwave bidirectionally transmitted in the waveguide 10 has been described, the invention is not limited to such a directional coupler. The directional coupler according to the invention may be configured to detect the microwave unidirecionally transmitted in the waveguide 10. This configuration can be achieved, for example, by replacing the detection circuits 15 in FIG. 4 with terminal circuits (not shown). In this case, the terminal circuit may be configured of a chip resistor having a resistance value of 50 ohms.

Next, operations and effects of the directional coupler in the first embodiment will be described.

Figure 5:
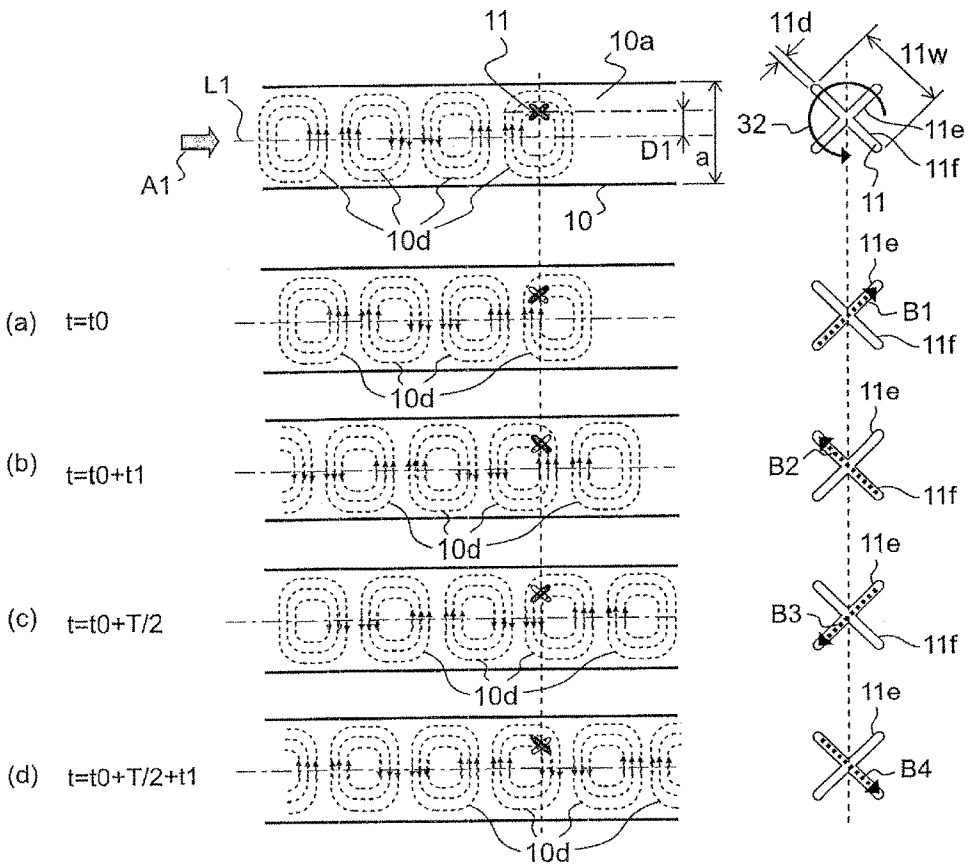
FIG. 5 is a diagram illustrating a principal that the cross opening emits the circularly polarized wave.

First, referring to FIG. 5, a principal that the cross opening 11 emits the circularly polarized wave will be described. FIG. 5 shows magnetic field distributions generated in the waveguide 10, which is represented as concentric elliptical dotted lines 10*d*. The orientation of the magnetic field distributions 10*d* is represented as arrows. The magnetic field distributions 10*d* travels in the waveguide 10 in a microwave transmitting direction A1.

As shown in (a) of FIG. 5, at time t=t0, the magnetic field distributions 10*d* are formed. At this time, one long hole 11*e* of the cross opening 11 is excited by the magnetic field represented as a broken arrow B. After an elapse of t1, that is, at time t=t0+t1, the other long hole 1 if of the cross opening 11 is excited by the magnetic field represented as a broken arrow B2. After an elapse of T/2 (T is a cycle of the microwave) from the state shown in (a) of FIG. 5, that is, at time t=t0+T/2 (T is cycle), one long hole 11*e* of the cross opening 11 is excited by the magnetic field represented as a broken arrow B3. Then, after an elapse of t1, that is, at time t=t0+T/2+t1, the other long hole 1 if of the cross opening 11 is excited by the magnetic field represented as a broken arrow B4. After an elapse of T from the state shown in (a) of FIG. 5, that is, at time t=t0+T, as in the case at time t=t0, one long hole 11*e* of the cross opening 11 is excited by the magnetic field represented as the broken arrow B1. The series of excitation is sequentially repeated, the microwave emitted from the cross opening 11 becomes a circularly polarized wave rotating in an anticlockwise direction 32, and is emitted to the outside of the waveguide 10.

It is given that the microwave transmitted in a direction of an arrow 30 in FIG. 3 is a travelling wave, and the microwave transmitted in a direction of an arrow 31 is a reflected wave. In this case, since the travelling wave is transmitted in the same direction as the transmitting direction A1 shown in FIG. 5, as described above, the microwave emitted from the cross opening 11 becomes a circularly polarized wave that rotates in the anticlockwise direction 32, and is emitted to the outside of the waveguide 10. In contrast, since the reflected wave is transmitted in the opposite direction to the transmitting direction A1 shown in FIG. 5, the microwave emitted from the cross opening 11 becomes a circularly polarized wave that rotates clockwise, and is emitted to the outside of the waveguide 10.

Figure 6:
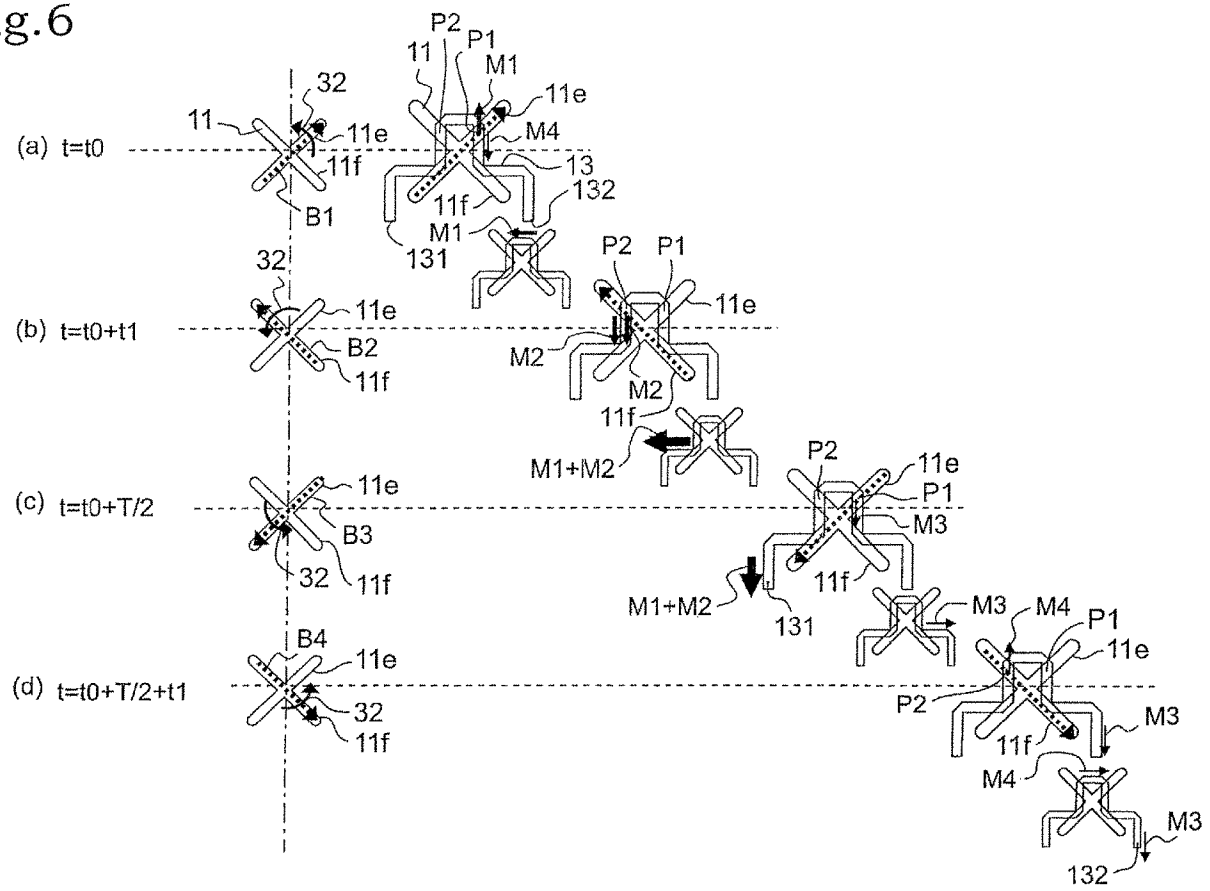
FIG. 6 is a diagram illustrating the orientation and amount of the microwave transmitted through the microstrip line, which vary with time.

The circularly polarized wave emitted to the outside of the waveguide 10 is coupled at the microstrip line 13 opposed to the cross opening 11. At this time, in the case where the first to third transmission lines 13*a* to 13*c* of the microstrip line 13 are formed as described above, the microwave emitted from the cross opening 11 as the travelling wave transmitted in the direction of the arrow 30 is mostly outputted to the output part 131 of the microstrip line 13. Meanwhile, the microwave emitted from the cross opening 11 as the reflected wave transmitted in the direction of the arrow 31 is mostly outputted to the output part 132 of the microstrip line 13. Referring to FIG. 6, this will be described below in more detail.

FIG. 6 is a diagram illustrating the orientation and amount of the microwave transmitted through the microstrip line 13, which vary with time. A gap is present between the microstrip line 13 and the cross opening 11 and thus, the microwave reaches the microstrip line 13 with a delay caused by transmission of the microwave through the gap. For convenience of description, however, the delay is ignored. Here, an area where the cross opening 11 and the microstrip line 13 cross each other in plan view is referred to as a coupling area. A substantial center of the coupling area where the cross opening 11 crosses the first transmission line 13*a* is referred to as a coupling point (first coupling point) P1, and a substantial center of the coupling area where the cross opening 11 crosses the second transmission line 13*b* is referred to as a coupling point (second coupling point) P2. In FIG. 6, the amount of the microwave transmitted through the microstrip line 13 is expressed in the thickness of arrows. That is, a large amount of microwave transmitted through the microstrip line 13 is expressed as a thick arrow, while a small amount of microwave transmitted through the microstrip line 13 is expressed as a thin arrow.

At time t=t0 shown in (a) of FIG. 6, the magnetic field represented as the broken arrow B1 excites one long hole 11*e* of the cross opening 11, generating a microwave represented as a thick solid arrow M1 at the coupling point P1 on the microstrip line 13. The microwave represented as the thick solid arrow M1 is transmitted on the microstrip line 13 toward the coupling point P2.

At time t=t0+t1 shown in (b) of FIG. 6, the magnetic field represented as the broken arrow B2 excites the other long hole 11*f* of the cross opening 11, generating a microwave represented as a thick solid arrow M2 at the coupling point P2 on the microstrip line 13. Here, when an effective transmission time of the microwave on the microstrip line 13 between the coupling point P1 and the coupling point P2 is set to time t1, the microwave generated at the coupling point P1 at time t=t0 is transmitted to the coupling point P2 at time t=t0+t1. The microwave has the same phase as a microwave generated at the coupling point P2 at time t=t0+t1. For this reason, the two microwaves are combined, and the combined microwaves are transmitted on the microstrip line 13 toward the output part 131, and after an elapse of a predetermined time, are outputted to the output part 131.

At time t=t0+T/2 shown in (c) of FIG. 6, the magnetic field represented as the broken arrow B3 excites one long hole 11*e* of the cross opening 11, generating a microwave represented as a thin solid arrow M3 at the coupling point P1 on the microstrip line 13. The microwave represented as the thin solid arrow M3 is transmitted on the microstrip line 13 toward the output part 132, and an elapse of a predetermined time, is outputted to the output part 132.

The reason why the solid arrow M3 is made thinner than the solid arrow M1 is as follows. As described above, the cross opening 11 emits the microwave (circularly polarized wave) that rotates in the anticlockwise direction 32. At the time t=t0 shown in (a) of FIG. 6, the transmitting direction of the microwave represented as the solid arrow M1 at the coupling point P1 on the microstrip line 13 is the substantially same as the rotating direction of the microwave emitted from the cross opening 11. For this reason, energy of the microwave represented as the solid arrow M1 is not reduced. At time t=t0+T/2 shown in (c) of FIG. 6, the transmitting direction of the microwave represented as the solid arrow M3 at the coupling point P1 on the microstrip line 13 is opposite to the rotating direction of the microwave emitted from the cross opening 11. For this reason, energy of combined microwaves is reduced. Thus, the amount of the microwave represented as the solid arrow M3 is smaller than the amount of the microwave represented as the solid arrow M1.

At time t=t0+T/2+t1 shown in (d) of FIG. 6, the magnetic field represented as the broken arrow B4 excites the other long hole 11*f* of the cross opening 11, generating a microwave represented as a thin solid arrow M4 at the coupling point P2 on the microstrip line 13. The microwave represented as the thin solid arrow M4 is transmitted toward the coupling point P1. The reason why the solid arrow M4 is made thin is the same as the above-mentioned reason why the solid arrow M3 is made thin.

At time t=t0+T, as in the case at time t=t0 shown in (a) of FIG. 6, the magnetic field represented as the broken arrow B1 excites one long hole 11*e* of the cross opening 11. At this time, the microwave represented as the thin solid arrow M4, which is not present at time t=t0 shown in (a) of FIG. 6, is present on the microstrip line 13. At time t=t0+T (that is, t=t0), the microwave represented as the thin solid arrow M4 is transmitted to the coupling point P1. The transmitting direction of the microwave represented as the solid arrow M4 is opposite to the transmitting direction of the microwave represented as the solid arrow M1 and thus, is cancelled and disappears. As a result, the microwave represented as the thin solid arrow M4 is not outputted to the output part 132.

Strictly speaking, the amount of the microwave transmitted from the coupling point P1 at time t=t0 is an amount acquired by subtracting the amount of the microwave represented as the solid arrow M4 from the amount of the microwave represented as the solid arrow M1 (M1−M4). Consequently, the amount of the microwave outputted to the output part 131 is an amount acquired by adding the amount of the microwave represented as the solid arrow M2 to the amount of the microwave transmitted from the coupling point P1 (M1+M2−M4). In consideration of this, the amount of the microwave outputted to the output part 131 (M1+M2−M4) is much larger than the amount of the microwave (M3) outputted to the output part 132 (M1+M2−M4>M3). Accordingly, in the case where the first to third transmission lines 13*a* to 13*c* of the microstrip line 13 are formed as described above, the microwave emitted anticlockwise from the cross opening 11 as the travelling wave transmitted in the direction of the arrow 30 is mostly outputted to the output part 131 of the microstrip line 13. In contrast, the microwave emitted clockwise from the cross opening 11 as the reflected wave transmitted in the direction of the arrow 31 is mostly outputted to the output part 132 of the microstrip line 13.

Preferably, the first transmission line 13*a* and the second transmission line 13*b* are symmetric with respect to a straight line that passes the opening center 11*c* of the cross opening 11 and is perpendicular to the tube axis L1 in plan view. This can improve individual detection of the travelling wave and the reflected wave.

Figure 7:
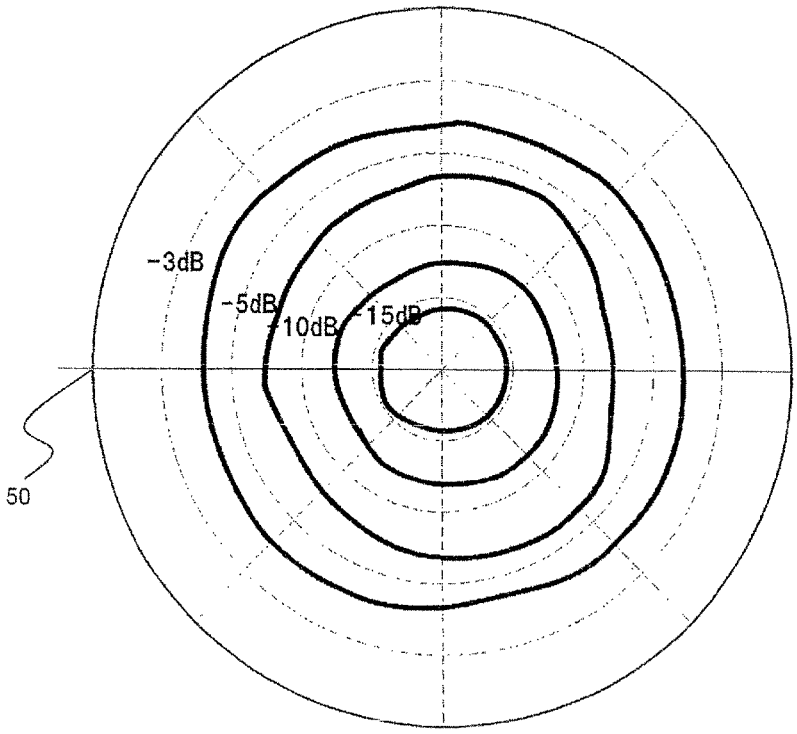
FIG. 7 is a polar diagram illustrating a characteristic of a reflected wave power detection port of the directional coupler having the distance between the first transmission line and the second transmission line of 4 mm.
Figure 8:
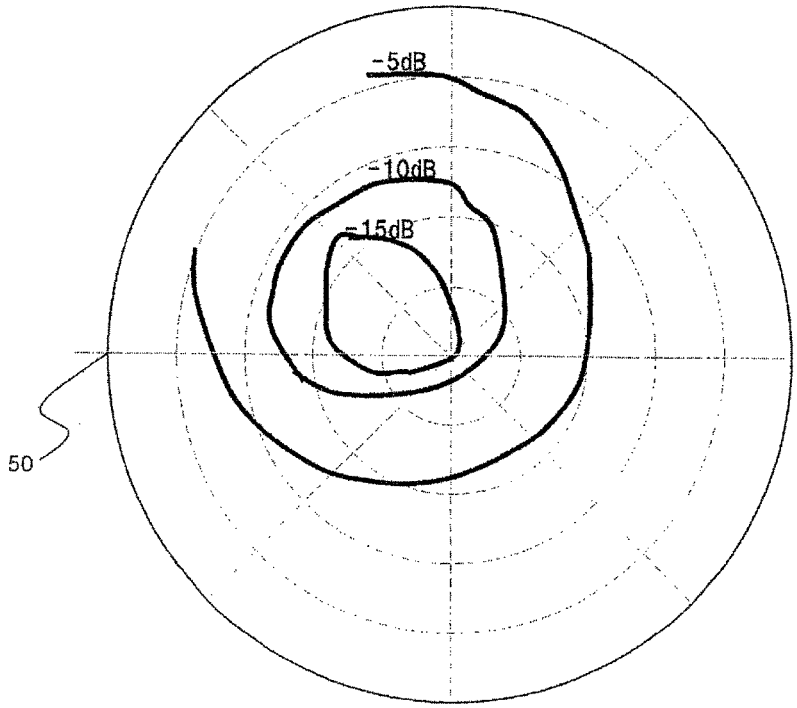
FIG. 8 is a polar diagram illustrating a characteristic of a reflected wave power detection port of the directional coupler having the distance between the first transmission line and the second transmission line of 2 mm.

When the travelling wave and the reflected wave are transmitted in opposite directions in the waveguide 10, a standing wave may occur in the waveguide 10, and the standing wave exerts a negative effect on individual detection of the travelling wave and the reflected wave. To solve the problem, a distance 13*g* between the first transmission line 13*a* and the second transmission line 13*b* (See FIG. 4) may be set as follows. FIG. 7 is a polar diagram illustrating a characteristic of a reflected wave power detection port of the directional coupler having the distance 13*g* of 4 mm. FIG. 8 is a polar diagram illustrating a characteristic of a reflected wave power detection port of the directional coupler having the distance 13*g* of 2 mm.

Data shown in FIG. 7 and FIG. 8 is acquired as follows. First, there is prepared a waveguide 10 having a width of 100 mm, a height of 30 mm, a thickness of the wall surface of 0.6 mm, a length 11*w* of the cross opening 11 of 20 mm, and the width 11*d* of the cross opening 11 of 2 mm. An input terminal of the microwave is connected to one end of the waveguide 10, and a load capable of changing the level and phase of the reflected wave is connected to the other end of the waveguide 10. Then, a microwave signal is inputted from the input terminal of the microwave, and the level and phase of the reflected wave are changed by the load, and the amount of the microwaves detected by the output parts 131 and 132 of the microstrip line 13 are measured with a network analyzer. Here, it is given that the amount of the microwave (travelling wave) detected by the output part 131 is S21, and the amount of the microwave (reflected wave) detected by the output part 132 is S31. Subsequently, S31–S21 is calculated, and is expanded on polar coordinates of Smith chart.

In FIG. 7 and FIG. 8, a reference face (face on which the travelling wave is fully reflected and its phase varies by 180 degrees) 50 is shown using an input terminal of the load as a reference. The center of the polar coordinates indicates the amount S31 of the reflected wave of "0 (zero)". The circumference that is the outermost contour of the polar coordinates indicates that the travelling wave wholly becomes the reflected wave. That is, the amount S31 of the reflected wave increases toward the circumference that is the outermost contour of the polar coordinates. Accordingly, a value acquired by subtracting the amount of the travelling wave from the amount of the reflected wave (S31–S21) decreases (due to expression in dB in FIG. 7 and FIG. 8, a negative numerical value becomes smaller).

The circumferential direction of the polar coordinates relates to phase, and indicates the phase of the reflected wave at the position where the directional coupler is disposed (however, because the input face of the load is the reference face in FIG. 7 and FIG. 8, the phase is relative indication). That is, on the same circumference of the polar coordinates, the phase of the reflected wave varies, but the amount of the reflected wave (power level) is the same. Accordingly, when the value acquired by subtracting the amount of the travelling wave from the amount of the reflected wave (S31–S21) is expanded on the polar coordinates, contour lines are ideally concentric.

As shown in FIG. 7, when the distance 13*g* is set to 4 mm, the contour lines (thick lines) are substantially concentric. This demonstrates that by setting the distance 13*g* to 4 mm, even in the state where the reflected wave exists (that is, the standing wave occurs in the waveguide 10), the directional coupler can be installed at any location to improve practical value. As shown in FIG. 8, when the distance 13*g* is set to 2 mm, the contour lines (thick lines) are eccentric from the center of the polar coordinates. This demonstrates that when the distance 13*g* is set to 2 mm, in the state where the reflected wave exists, the detection characteristics vary depending on the location of the directional coupler to lower practical value. Although not shown, when the distance 13*g* is set to 8 mm, the substantially same characteristics are found as in the case of the distance 13*g* of 2 mm.

Therefore, it is found out that the problem on the standing wave can be solved by properly setting the distance 13*g* according to the size of the waveguide 10 or the cross opening 11.

Next, a preferred method of setting the distance 13*g* will be described.

As described above, FIG. 6 shows the orientation and amount of the microwave transmitted through the microstrip line 13 at each time without reference to a delay caused by the gap between the microstrip line 13 and the cross opening 11. A transmission time during which the microwave represented as the solid arrow M1 travels from the coupling point P1 to the coupling point P2 is defined as t1. However, the gap between the microstrip line 13 and the cross opening 11 is actually present. As the gap is larger, a time difference between the microwave (solid arrow M1) coupled at the coupling point P1 and the microwave (solid arrow M2) coupled at the coupling point P2 becomes smaller than that in the time t1.

Given that the distance 13*g* is 4 mm, and the gap between the wide face 10*a* of the waveguide 10 and the printed circuit board B face 12*b* is 6 mm, on a plane away from the wide face 10*a* of the waveguide 10 by 5 mm (that is, a plane away from the microstrip line 13 by 1 mm), a phase difference between the coupling points P1 and P2, which was found by computer analysis, was about 55 degrees. Under the same conditions except for the distance 13*g* of 2 mm, the phase difference between the coupling points P1 and P2, which was found by computer analysis, was about 38 degrees. Further, under the same conditions except for the distance 13*g* of 8 mm, the phase difference between the coupling points P1 and P2, which was found by computer analysis, was about 9 degrees.

When calculating the phase difference between the coupling points P1 and P2 on the microstrip line 13 on the basis of effective transmission wavelength of the microwave, the phase difference was about 55 degrees. Even when the distance 13*g* is changed to 2 mm, 4 mm, or 8 mm, the length of the microstrip line 13 from the coupling point P1 to the coupling point P2 is assumed to be the same.

That is, when the distance 13*g* is set to 4 mm, the phase difference between the coupling points P1 and P2, which is found by computer analysis, matches the phase difference between the coupling points P1 and P2, which is calculated based on the effective transmission wavelength of the microwave. In this case, as described above with reference to FIG. 6, the microwave represented as the solid arrow M1 has the same phase as the microwave represented as the solid arrow M2 at the coupling point P2. As a result, the two microwaves are coupled, transmitted on the microstrip line 13 toward the output part 131, and outputted to the output part 131. As shown in FIG. 7, the characteristic contour lines are substantially concentric. Therefore, even in the state where the reflected wave is present, the directional coupler can be installed at any location, improving practical value.

When the distance 13*g* is set to 2 mm or 8 mm, the phase difference between the coupling points P1 and P2, which is found by computer analysis, is different from the phase difference between the coupling points P1 and P2, which is calculated based on the effective transmission wavelength of the microwave. In this case, as shown in FIG. 8, the contour lines are eccentric from the center of the polar coordinates. Consequently, in the state where the reflected wave is present, detection characteristics vary depending on the location of the directional coupler to lower practical value.

Thus, by properly setting the distance 13*g* according to the gap between the wide face 10*a* of the waveguide 10 and the printed circuit board B face 12*b*, the phase difference between the coupling points P1 and P2 can be optimized.

Given that the frequency band of the microwave is 2450 MHz, the width of the waveguide 10 is 100 mm, the height of the waveguide 10 is 30 mm, the distance D1 from the tube axis L1 to the opening center 11*c* of the cross opening 11 is 25 mm, the width 11*d* of the cross opening 11 is 2 mm, the length 11*w* of the cross opening 11 is 20 mm, the gap between the cross opening 11 and the printed circuit board B face 12*b* is 6 mm, and the distance 13*g* is 4 mm, the directional coupler properly functions.

The amount of the microwave emitted from the cross opening 11 with respect to the amount of the microwave transmitted in the waveguide 10 is determined depending on shape and size of the waveguide 10 and the cross opening 11. For example, with the above-mentioned shape and size, the amount of the microwave emitted from the cross opening 11 is about 1/10000 (about −50 dB) of the amount of the microwave transmitted in the waveguide 10.

Figure 9:
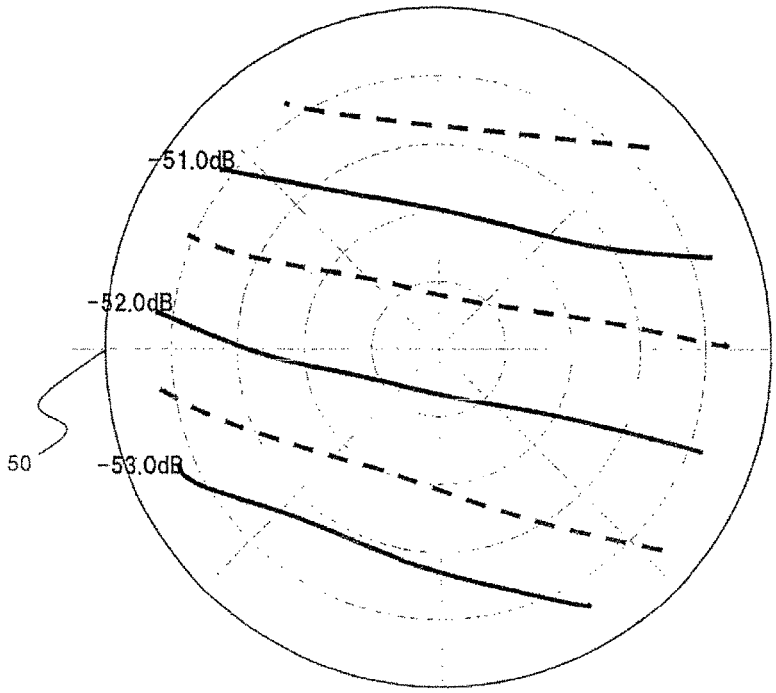
FIG. 9 is a polar diagram illustrating a characteristic of a travelling wave power detection port of the directional coupler having the distance between the first transmission line and the second transmission line of 4 mm.

FIG. 9 is a polar diagram illustrating a characteristic of the travelling wave power detection port of the directional coupler having the above-mentioned shape and size. That is, FIG. 9 illustrates the amount (S21) of the microwave (travelling wave) detected by the output part 131 on polar coordinates. As shown in FIG. 9, a variation in the amount of detected microwave (travelling wave) in the whole area of the polar coordinates, in consideration of variation in the load, is in the range of about −50.5 dB to −53.0 dB, and about 3 dB at the maximum. As this variation is smaller, signal processing of the detection circuits 15 becomes easier. With a variation of about 3 dB, even when using inexpensive parts as detection diodes, the detection circuits 15 can readily perform signal processing, which is practically valuable.

In the directional coupler in the first embodiment, since the cross opening 11 is located so as not to cross the tube axis L1 of the waveguide 10 in plan view, the microwave transmitted in the waveguide 10 can be readily emitted to the outside of the waveguide 10. The microwave emitted to the outside of the waveguide 10 is coupled on the microstrip line 13.

In the directional coupler in the first embodiment, since the travelling wave and the reflected wave are individually detected by using the different rotating directions of the circularly polarized wave emitted from the cross opening 11, the necessity of highly accurate size management can be eliminated while preventing upsizing of the device.

In the directional coupler in the first embodiment, the microstrip line 13 is configured to the face of the printed circuit board 12, which faces the cross opening 11, preventing upsizing of the device.

In the directional coupler in the first embodiment, since the cross opening 11 is configured of the two long holes 11*e* and 11*f* that cross each other into an X shape, and can emit the circularly polarized wave of a substantially complete round, the rotating direction of the circularly polarized wave becomes more definite. This can individually detect the travelling wave and the reflected wave with high accuracy.

In the directional coupler in the first embodiment, the conductive support part 14 surrounds the cross opening 11 in plan view, and the copper foil is configured to the face of the printed circuit board 12, which does not face the cross opening 11. With this configuration, the microwave emitted from the cross opening 11 can be prevented from leaking to the outside of the support part 14 and the printed circuit board 12. This can also suppress unnecessary radiation of the microwave to electric parts and control signal lines near the support part 14 and the printed circuit board 12, preventing malfunction.

In the directional coupler in the first embodiment, the support part 14 has through holes 141 and 142 through which both ends of the microstrip line 13 pass, and the output parts 131 and 132 are disposed outside of the support part 14. With this configuration, the support part 14 can prevent the microwave emitted from the cross opening 11 from leaking to the outside of the support part 14 and the printed circuit board 12, and only the signal detected by the microstrip line 13 can be taken out of the support part 14.

In the directional coupler in the first embodiment, the output parts 131 and 132 are connected to the detection circuits 15 or the terminal circuits (not shown) outside of the support part 14. With this configuration, the detection circuits 15 or the terminal circuits can be prevented from malfunctioning due to the radiation of the microwave emitted from the opening.

In the directional coupler in the first embodiment, the detection circuits 15 or the terminal circuits (not shown) and the microstrip line 13 are provided on the same printed circuit board 12. With this configuration, the configuration of the printed circuit board 12 can be simplified, maintaining high reliability.

In the directional coupler in the first embodiment, the first and second transmission lines 13*a* and 13*b* extend substantially vertical to the tube axis L1 in plan view. With this configuration, the effect of the impedance of the load connected to the waveguide 10 can be reduced, keeping high accuracy of separation of the microwave bidirectionally transmitted in the waveguide 10.

In the directional coupler in the first embodiment, one end of the first transmission line 13*a* and one end of the second transmission line 13*b* are connected to the third transmission line 13*c* substantially parallel to the tube axis L1 in plan view. With this configuration, the separation of the microwave bidirectionally transmitted in the waveguide 10 can be improved, and the configuration of the microstrip line 13 becomes qualitative, facilitating the design of a practical configuration.

Preferably, the area surrounded with the first to third transmission lines 13*a*, 13*b*, and 13*c* is smaller than the cross opening area 11*a*. Especially as shown in FIG. 4, it is preferred that the first and second transmission lines 13*a* and 13*b* are located between the opening center 11*c* and ends of the cross opening area 11*a* (right and left ends in FIG. 4), and the third transmission line 13*c* is located between the opening center 11*c* and an end of the cross opening area 11*a* (upper end in FIG. 4). With this configuration, the travelling wave and the reflected wave can be individually detected with high accuracy.

The invention is not limited to this embodiment, and may be embodied in other various modes. For example, although in the above the opening configured in the wall surface of the waveguide 11 is configured of the two long holes 11*e* and 11*f* that cross each other into an X shape, the invention is not limited to this. The opening in the wall surface of the waveguide 11 may have any shape that can emit the circularly polarized wave. The opening in the wall surface of the waveguide 11 may be configured of two or more long holes inclined at different angles relative to the tube axis L1 of the waveguide 11 in plan view, as long as the opening can emit the circularly polarized wave. The crossing position of the two or more long holes may displace from the centers of the long holes. For example, the opening may be L-shaped or T-shaped. The opening may be configured of three or more long holes. It is confirmed that the X-shaped opening configured of two long holes that cross each other at a crossing angle of 30 degrees can emit the circularly polarized wave. However, in this case, the microwave emitted from the opening becomes an elliptical circularly polarized wave. In contrast, the opening configured of two long holes that are orthogonal to each other at their centers can emit a circularly polarized wave of a substantially complete round. In this case, the rotating direction of the electric field becomes more definite, achieving individual detection of the travelling wave and the reflected wave with high accuracy.

Figure 10:
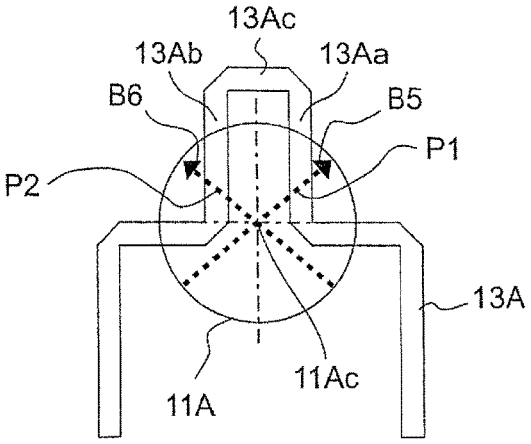
FIG. 10 is a plan view illustrating a relationship between the opening and the microstrip line in the case where the cross opening of the directional coupler in FIG. 1 is replaced by the circular opening.

The opening may be a circular opening 11A as shown in FIG. 10 or a polygonal opening (not shown). In this case, the microstrip line 13 only need to include first and second transmission lines 13Aa and 13Ab that pass across the circular opening 11A so as to cross the tube axis L1 in plan view, and opposed to each other across an opening center 11Ac of the opening 11A. The first transmission line 13Aa and the second transmission line 13Ab only need to be interconnected at a position displaced from the area vertically above the opening 11A. The coupling point P1 and the coupling point P2 are located as shown in FIG. 10. In FIG. 10, broken arrows represent magnetic fields B5 and B6 excited through the coupling points P1 and P2, respectively.

As described above, the opening may have any shape that can emit the circularly polarized wave. The opening may be configured of two or more long holes inclined at different angles relative to the tube axis L1 of the waveguide 10 in plan view, as long as the opening can emit the circularly polarized wave. The opening may be substantially circular formed by stacking a plurality of long holes at different angles, or may be a square formed by connecting four apexes (ends) of the X-shaped long holes 11*e* and 11*f*. The opening may have various shapes including ellipse, rectangle, trapezoid, heart-shape, and star-shape. Advantageously, circular and rectangular openings are less deformed than openings of complicated shapes, for example, X-shaped opening.

Second Embodiment

Figure 11:
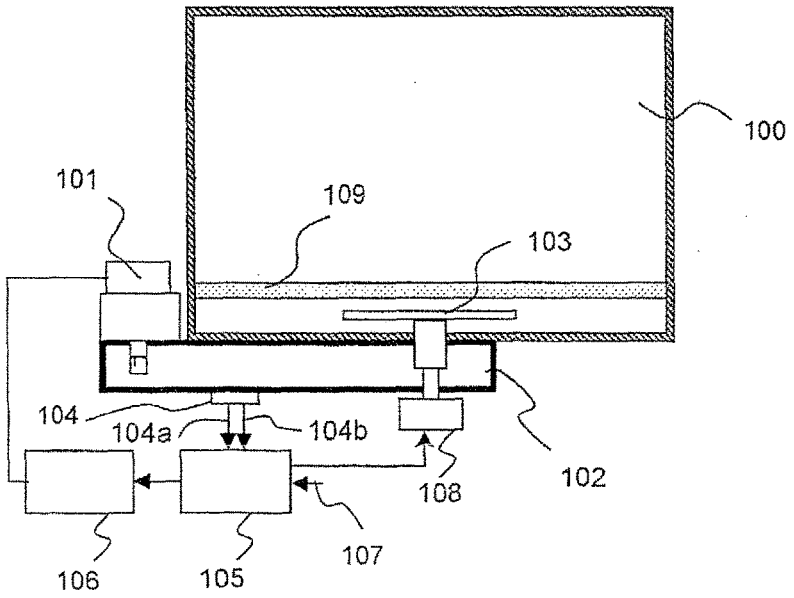
FIG. 11 is a schematic diagram illustrating the configuration of a microwave heater in a second embodiment of the invention.

Next, a microwave heater in the second embodiment of the invention will be described with reference to FIG. 11. FIG. 11 is a diagram illustrating the configuration of the microwave heater in the second embodiment of the invention.

The microwave heater in the second embodiment shown in FIG. 11 includes a heating chamber 100 for accommodating a heating object, a microwave generating part 101 for generating a microwave, a waveguide 102 for transmitting the microwave generated by the microwave generating part 101, and a microwave emitting part 103 for emitting the microwave transmitted in the waveguide 102 to the heating chamber 100. A directional coupler 104 according to the first embodiment is provided on a wall surface (wide face) of the waveguide 102 between the microwave generating part 101 and the microwave emitting part 103.

The directional coupler 104 detects each of a detection signal 104*a* corresponding to a travelling wave transmitted in the waveguide 102 from the microwave generating part 101 toward the microwave emitting part 103 and a detection signal 104*b* corresponding to a reflected wave transmitted in the waveguide 102 from the microwave emitting part 103 toward the microwave generating part 101, and sends the signals to a control part 105.

The control part 105 receives a signal 107 of, for example, heating conditions input to an input part (not shown) of the microwave heater by the user and a detection signal of a sensor (not shown) for detecting the weight and steam amount of the heating object. The control part 105 controls a driving power source 106 and a motor 108 according to the detection signals 104*a* and 104*b* and the signal 107 to heat the heating object accommodated in the heating chamber 100. Under the control by the control part 105, the driving power source 106 supplies electric power for generating the microwave to the microwave generating part 101. Under the control by the control part 105, the motor 108 generates power for rotating the microwave emitting part 103.

With the microwave heater in the second embodiment, the directional coupler 104 can detect a temporal change of the amount of the reflected wave on the basis of a physical change of the heating object itself due to heating, thereby grasping the heating state of the heating object. The directional coupler can also grasp a change of the inside of the heating object, and the type and amount of the heating object. Therefore, the microwave heater in the second embodiment is convenient.

INDUSTRIAL APPLICABILITY

A directional coupler according to the invention can eliminate the necessity of highly accurate size management while preventing upsizing of the device and thus, is suitable as a directional coupler used in commercial microwave appliances (for example, electronic ovens and microwave ovens) of limited size and industrial microwave appliances.

Although the invention has been fully described in connection with the preferred embodiments thereof with reference to the accompanying drawings, it is to be noted that various changes and modifications are apparent to those skilled in the art. Such changes and modifications are to be understood as included within the scope of the invention as defined by the appended claims unless they depart therefrom.

The entire disclosure of Japanese Patent Application Nos. 2013-016522 and 2013-163009 filed on Jan. 31, 2013 and Aug. 6, 2013, respectively, including specification, drawings, and claims are incorporated herein by reference in its entirety.

What is claimed is:

1. A directional coupler comprising:

a waveguide having an opening in a wall surface thereof; and a coupling line disposed on an outer side of the waveguide, wherein the opening is configured to not cross a tube axis of the waveguide in plan view, and to emit a circularly polarized wave, the coupling line includes:

a first transmission line, a second transmission line, and output parts disposed at both ends of the coupling line, the first transmission line and the second transmission line extending across the opening in plan view and being opposed to each other across a center of the opening, and the first transmission line and the second transmission line are interconnected at a position displaced from an area vertically above the opening.

2. The directional coupler according to claim 1, further comprising a printed circuit board, wherein the coupling line is on a first face of the printed circuit board, the face being opposed to the opening.

3. The directional coupler according to claim 1, wherein the opening is defined by two long holes that cross each other so as to define an X shape.

4. The directional coupler according to claim 1, wherein the coupling line is between a first coupling point located substantially at a center of a coupling area where the opening crosses the first transmission line, and a second coupling point located substantially at a center of a coupling area where the opening crosses the second transmission line, in plan view, and is configured such that a microwave generated at the first coupling point and a microwave generated at the second coupling point correspond to a rotating direction of a circularly polarized wave, and have a same phase at the first coupling point or the second coupling point.

5. The directional coupler according to claim 2, further comprising a conductive support part that is configured to support the printed circuit board on an outer face of the waveguide and to surround the opening in plan view, and a microwave reflective member, wherein the microwave reflective member is on a second face of the printed circuit board, the second face opposite the first face and not opposed to the opening.

6. The directional coupler according to claim 5, wherein the support part has through holes through which both ends of the coupling line pass, and the output parts are disposed outside of the support part.

7. The directional coupler according to claim 6, wherein the output parts are connected to detection circuits or terminal circuits outside of the support part.

8. The directional coupler according to claim 7, wherein the detection circuits or the terminal circuits are on the printed circuit board.

9. The directional coupler according to claim 1, wherein the first transmission line and second transmission line extend substantially perpendicular to a tube axis in plan view.

10. The directional coupler according to claim 9, wherein one end of the first transmission line and one end of the second transmission line are connected to a third transmission line substantially parallel to the tube axis in plan view.

11. A microwave heater comprising the directional coupler according to claim 1.

* * * * *